United States Patent [19]

Steiner

[11] Patent Number: 4,658,555

[45] Date of Patent: Apr. 21, 1987

[54] ATTIC HATCHWAY INSULATING COVER

[76] Inventor: Thomas J. Steiner, 88 Pumpkin Hill Rd., Levittown, Pa. 19056

[21] Appl. No.: 754,459

[22] Filed: Jul. 12, 1985

[51] Int. Cl.[4] ..... E02D 29/14

[52] U.S. Cl. ..... 52/202; 52/19; 49/463; 182/77

[58] Field of Search ..... 52/19, 186, 309.9, 405; 114/201 R; 49/463, 466; 182/77

[56] References Cited

U.S. PATENT DOCUMENTS

| | | | |
|---|---|---|---|
| 2,100,124 | 11/1937 | Gilpin | 52/19 |
| 2,239,033 | 4/1941 | Cartmill | 52/19 |
| 2,770,965 | 11/1956 | Engel | 52/405 |
| 3,512,323 | 5/1970 | Hupfer | 52/309.9 |
| 4,097,228 | 7/1978 | Kosling | 49/466 |
| 4,140,824 | 2/1979 | Gaillard | 52/309.9 |
| 4,151,894 | 5/1979 | Edwards | 49/463 |
| 4,315,962 | 2/1982 | Skoien | 52/408 |
| 4,471,591 | 9/1984 | Jamison | 52/309.9 |

FOREIGN PATENT DOCUMENTS

| | | | |
|---|---|---|---|
| 7509141 | 10/1976 | France | 52/309.9 |

*Primary Examiner*—Henry E. Raduazo
*Attorney, Agent, or Firm*—John J. Simkanich

[57] ABSTRACT

An insulating cover provides a easily removed thermal barrier over a hatchway used for access to an attic or other unheated area located above a heated living space. A cap, besides providing thermal insulation, provides an insulated dome or pocket space above the hatch, this space being used to manipulate a hatch cover or folding stairway. The seating surface of the insulating cap interlocks with a deck member on the attic floor sufficiently to hold it in place while allowing seepage of air during closing of the hatch cover or folding stairway. It is well known that such closing of a folding stairway of common design can cause an air movement or air rain into the stairwell opening. Only materials with high thermal "R" value are used.

7 Claims, 4 Drawing Figures

ATTIC HATCHWAY INSULATING COVER

BACKGROUND OF THE INVENTION

This invention relates to insulating materials and is directed to a cover or cap which sits over a folding stairwell.

With the advent of the energy crisis in the 1970's various methods and materials have come into use to better thermally insulate heated and air conditioned (cooled) living spaces. Among these have been to increase the insulation depth in attic joist spaces and attic decks. Many homes have folding stairways for attic access, however, these have remained uninsulated because of their cumbersome structure and therefore remain a source of considerable heat loss. Fewer, yet a considerable number of homes have attic fans which open into the attic space from a ceiling area. They are used to draw hot air out of the house during the summer months. During the winter months they, again allow heat loss.

Custom permanently affixed insulating covers have been made for many purposes. But no removeable cover has been made for folding stairways. This is because the residential dwelling has long been overlooked in the marketplace for anything other than custom affixed work. Further, such a removable cover must remain in proper place when the spring loaded folding stairway is "slammed" closed.

SUMMARY OF THE INVENTION

A rigid cap provides a thermal pocket above a folding stairway opening. This pocket, usually rectangualr in shape, provides a free space into which the members of the folding stairway can be folded. The cap is made entirely of materials having a high thermal "R" value. A thermal barrier is thereby created over the opening.

A reflective foil can be used as one type of covering. Fiberglass batt, foam or other thermal material is sandwiched between the faces of the covering. "R" values up to R 40 or more can be easily met.

A flat frame is made on the deck of the attic joists. This frame is the surface against which the seating surface of the cap seats and interlocks. Ordinary and inexpensive building materials can be chosen for this flat frame. Number 2 exterior or interior plywood or particle waffer board is desired.

A sealing member on the cap interlocks with the rough wood surface. The cap sealing member is preferably contructed of fiberglass batt.

DESCRIPTION OF THE DRAWINGS

The novel features of this invention will be better understood from a reading of the following detailed description of the invention with the accompanying drawings in which like numerals refer to like elements and in which.

DETAILED DESCRIPTION OF THE INVENTION

An insulating attic hatchway cover is particularly adapted for use to insulate folding stairways and attic fans.

Figure 1:
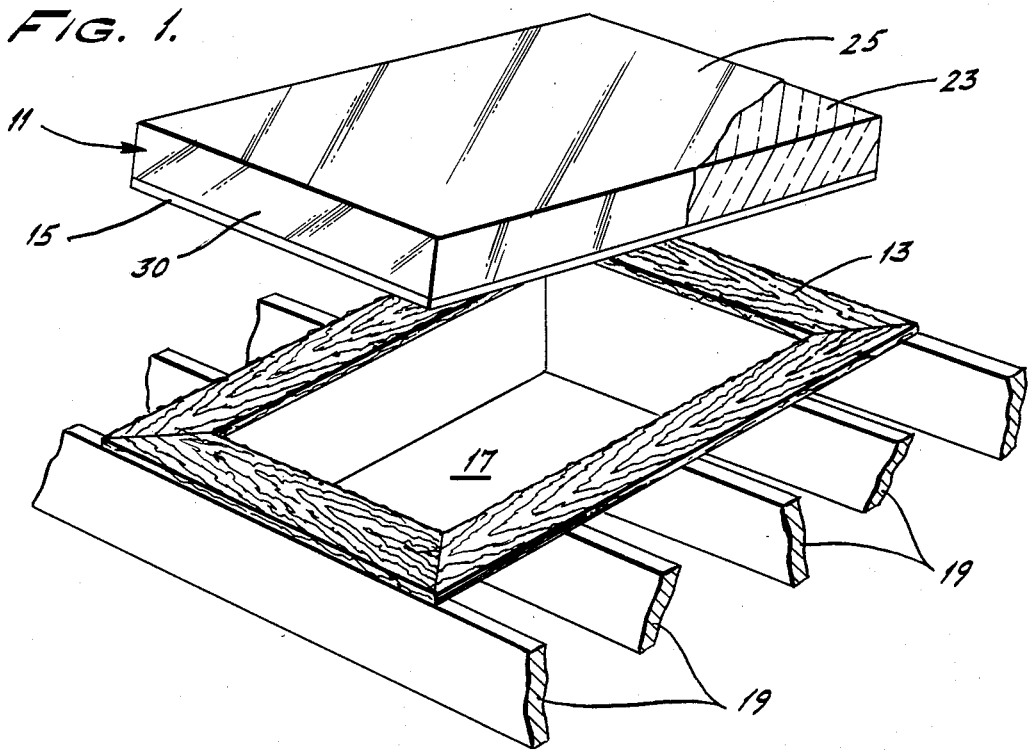
FIG. 1 is a perspective view of the cap and mating seating framework.

A cap member 11, FIG. 1, has a seal 15 which seats the cap member 11 against the flat surface of a framework 13 around a stairwell opening 17.

The framework 13 is made of ½ inch to ¾ inch thick Number 2 exterior or interior plywood, which has a slightly rough surface, as normally found in the marketplace. Particle board or waffer board both commonly known and used in the building trade can also be used.

This framework 13 is nailed or otherwise secured to the upper surfaces/edges of attic joists 19. It surrounds the stairwell opening 17 and extends outwardly about 5–10 inches in distance. Because of its rough surface, it provides an interlocking surface action.

The cap 11 is rectangularly shaped and sized to cover the usual 25 inches by 54 inches opening for a folding stairwell. It's outer surface has a reflective foil covering.

Figure 2:
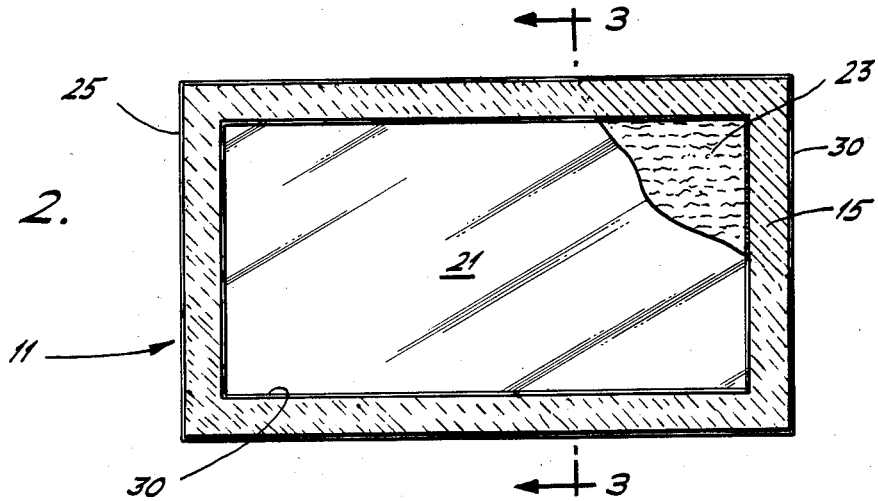
FIG. 2 is a face view of the bottom of the cap of the present cover invention.

The inside of the cap 11, FIG. 2, has a flat deck 21. This deck 21, as well as, the side walls of the cap 11, both inside and outside walls surfaces have a reflective foil covering.

Figure 3:
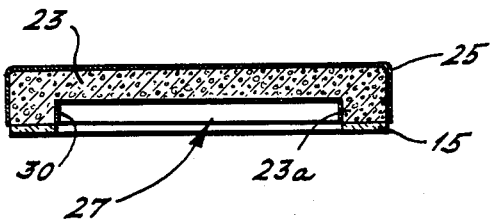
FIG. 3 is a crossection view of the cap structure as taken in FIG. 1.

The cap 11, FIG. 3, can be made of a solid pieces of insulation 23, such a celluar foam, having a high thermal "R" value. The foam 23 is rigid and is reasonably light. A thin covering 25 can extend over the outside of the foam 23 to protect it during handling. A seal member 15, being a ½ inch to 1 inch thick batt of fiberglass insulation extends about the bottom edge of the side wall **23*a* of the insulation 23. The side wall 23*a* extending about the perimeter edge of the cap 11 is high enough to create a space 27 within the cap 11 of from 15 inches to 24 inches. This space 27 allows the deck portion 21** to be held above and thereby clears a folding stairway.

Figure 4:
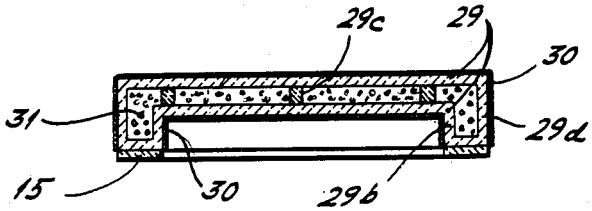
FIG. 4 is an alternate embodiment shown in crossection.

As an alternative to sold cap 11 of FIG. 3, the cap 11 can be made to be hollow. Sheets of foil 30 covered high "R" value foam 29 are glued to form an outer wall and inner wall for the cap 11, FIG. 4. The outer wall **29*a* is held away from the inner wall 29*b* by a plurality of spacer ribs 29*c*. Preferably, these spacer ribs 29*c* are also of the same material as the outer and inner walls 29*a*, 29*b*. These walls 29*a*, 29*b* can be from ½ inch to 1 inch thick and the space 31 formed by the ribs 29*c*** can be from ½ inch to 3 inches wide.

The space 31 can be left as an air pocket or can be filled with insulation.

End caps **29*d* cover the ends of the side walls and seal of the airpocket space 31. A seal 15 member is flued to the wall end caps 29*d*. This seal 15** can be compressable, open celluar foam or a fiberglass batt from ½ inch to 1 inch thick.

The seal 15 compresses slightly under the weight of the cap 11 and conformed to the rough surface of the framework 13. The glass fibers interlock with the rough surface of the framework 13 to keep the cap 11 from shifting. This interlocking is necessary as folding stairways have a cover plate which causes a wave of air into the opening 17 when closed. Such a wave of air could move or jar the cap 11 out of place if it were not held from sliding by the friction created by the interlocking action between the fiberglass seal 15 and the framework 13.

The description above is intended to be illustrative of the invention. Changes can be made in materials and shape without departing from the intent and scope of the invention.

What is claimed is:

1. An insulating cover for an attic stairwell opening structure, said attic stairwell opening structure including a folding stairway and stairwell opening framework tied to attic joists, said insulating cover being separate from said attic stairwell opening structure, comprising:

cover framework, separate from said building stairwell opening structure, for surrounding said stairwell opening framework and for being in abutment therewith from above, said cover framework having a rough upper face;

a cap being seatable on said framework and removable therefrom, said cap having a raised deck portion and perimeter sidewalls extending therefrom, and including high "R" value insulating materials; and a seal being of a material selected from open cellular foam and fiberglass batt, extending along the bottom of said sidewalls of said cap, said seal being compressable to conform to the upper face of said framework wherein said seal face interlocks with said deck rough face whereby said seal permits the seepage of air during a closing of said folding stairway.

2. The cover of claim 1 wherein said seal has a rough surface, said seal surface interlocking with said framework surface when said cap is in place to impede shifting thereof; and wherein said sidewalls establish a space within the cap.

3. The cover of claim 2 wherein said cap is covered with reflective foil on its deck portion and on its perimeter sidewalls.

4. The cover of claim 3 wherein said seal is a fiberglass batt.

5. The cover of claim 4 wherein said cap is made of foam insulation.

6. An insulating cover for an attic stairwell opening, comprising:

framework, surrounding said stairwell opening, said framework providing a flat deck surface having a rough upper face;

a cap being seatable on said framework and removable therefrom, said and perimeter sidewalls extending therefrom, and being comprised of high "R" value insulating materials; and a seal extending along the bottom of said sidewalls of said cap, said seal being compressable to conform to the upper face of said framework and being intented to be interlocking matable therewith, said seal, being made of high "R" value insulating material;

wherein said seal is a fiberglass batt and has a rough surface, said seal surface interlocking with said framework surface when said cap is in place to imped shifting thereof; and wherein said cap is made of foam insulation and is covered with reflective foil on its deck portion and on its perimeter side walls.

7. The cover of claim 6 wherein said space between walls is filled with fiberglass insulation.

* * * * *